United States Patent [19]

Sunakawa et al.

[11] Patent Number: 4,504,220

[45] Date of Patent: Mar. 12, 1985

[54] DRYING APPARATUS WITH DEODORIZING SYSTEM FOR A PRINTING MACHINE

[75] Inventors: Kiyoshi Sunakawa, Zama; Shinichi Maruyama, Tokyo, both of Japan

[73] Assignees: Toshiba Kikai Kabushiki Kaisha; Netsu Kogyo Kabushiki Kaisha, both of Tokyo, Japan

[21] Appl. No.: 483,380

[22] Filed: Apr. 8, 1983

[30] Foreign Application Priority Data

Apr. 9, 1982 [JP] Japan ..... 57-58309

[51] Int. Cl.[3] ..... F27B 9/28; F27B 9/40

[52] U.S. Cl. ..... 432/72; 101/416 A; 432/37; 432/59

[58] Field of Search ..... 432/72, 59, 37; 101/416 A

[56] References Cited

U.S. PATENT DOCUMENTS

| | | | |
|---|---|---|---|
| 2,658,742 | 11/1953 | Suter et al. | 432/72 |
| 3,757,427 | 9/1973 | Wilkinson | 34/32 |
| 4,384,850 | 5/1983 | Dixon | 432/72 |

FOREIGN PATENT DOCUMENTS 2922513 6/1979 Fed. Rep. of Germany .

*Primary Examiner*—John J. Camby

*Attorney, Agent, or Firm*—Birch, Stewart, Kolasch & Birch

[57] ABSTRACT

A drying apparatus with a deodorizing member for a printing machine including a hot blast nozzle for directing a hot blast against a web of printed material for drying the printed material. The deodorizing member includes a preheating chamber provided with a burner for preheating a collective process gas including a portion of a used process gas already used during the drying operation. A catalytic layer is provided for oxidizing the used process gas and is operatively connected to a fan for supplying the used process gas through the catalytic layer. A duct circuit is provided for dividing a treated process gas including a hot blast obtained by the treatment with the deodorizing member into two parts and discharging one portion of the two parts and subdividing the other portion into two parts and introducing one part thereof to an odor collective chamber connected to the preheating chamber and introducing the other part to a hot blast mixing chamber into which the other part of the foregoing used process gas is supplied. In addition, a hot blast circulating blower is provided for supplying a mixture process gas of the treated process gas and the used process gas in the foregoing hot blast mixing chamber to the hot blast nozzle.

7 Claims, 3 Drawing Figures

DRYING APPARATUS WITH DEODORIZING SYSTEM FOR A PRINTING MACHINE

BACKGROUND OF THE INVENTION

1. Field of the Invention

This invention relates to a hot blast type drying apparatus having a deodorizing system combined therewith, for blowing a hot blast against a printed web or sheet for drying the ink thereon.

2. Description of Background Information

In a conventional hot blast type drying apparatus used for a web offset printing press, for instance, for drying a printed portion of a web by evaporizing a solvent in the ink by blowing a hot blast against the web, the hot blast is generated mainly by burning a fuel gas. However, fuel consumption has increased in view of the high speed of the latest high speed printing machines.

In addition, the exhaust gas discharged from a drying apparatus into the atmosphere includes vapors of the solvent from the ink, and the solvent vapor includes bad smelling substances originated from hydrocarbon and ink composition which are the main components of the solvent. Therefore, if the vapors are discharged into the atmosphere and are left intact, complaints may be voiced by neighbors and the atmospheric air may be contaminated.

In order to prevent the above occurrence, there has been hitherto additionally used a burning-up oven called "a deodorizing apparatus". The deodorizing apparatus requiring the least energy consumption is a catalytic type burning-up oven carrying out an oxidizing reaction with the solvent at a comparatively low temperature by using a catalytic layer. This burning-up oven is also such that there is provided a heat exchanger between a duct for discharging the treated exhaust gas from the burning-up oven and a duct for discharging an untreated exhaust gas from the drying oven so that the temperature of the untreated exhaust gas may be raised to some extent and thereafter is preheated by a burner of the burning-up oven to a temperature suitable for the catalytic combustion.

In the above case, it has been usual that the burning-up oven is installed outside a printing room, and the drying oven and the burning-up oven are interconnected by a duct.

The foregoing apparatus has solved, at any rate, an environmental pollution problem, but has raised some problems as mentioned below:

(a) Beside the fuel consumption necessary for the drying oven, an additional fuel consumption for operating the burning-up oven is necessary.

(b) During the time when the used gas is passing through the duct connected between the drying oven and the burning-up oven the gas is cooled and vapors of the solvent contained therein are condensed and adhere to the inner surface of the duct. Further, the vapors may be carbonized or polymerized into high viscous tar during the lapse of a long time period. Such tar is accumulated on the inner surface of the duct. The tar is a combustible substance which may produce a fire in the duct. To prevent this occurrence, the inside of the duct has to be cleaned.

For solving the above problems, a countermeasure is known wherein the burning-up oven is placed on the drying oven so as to make the length of the duct as short as possible to decrease the above problem concerning the duct. Further, a system is known wherein the components of the hot blast circulating in the drying oven is passed through a heat exchanger connected to the burning-up oven and part of the quantity of heat generated at the burning-up oven is collected in the drying oven.

However, even by using the above countermeasures under the best conditions, wherein the amount of ink applied onto the printed web is the largest and the feeding speed of the printed web is the highest, the result is that the amount of calories generated by the total fuel consumption necessary for the drying oven and the burning-up oven can be compensated with the amount of calories generated by the fuel consumption necessary for the conventional hot blast drying oven alone.

SUMMARY AND OBJECTS OF THE INVENTION

A purpose of this invention is to provide a drying apparatus combined with a deodorizing means for a printing machine in which a possibility of a fire in a duct may be eliminated. The present invention does not require a complicated maintenance thereof and environmental pollution by the exhaust gas may be eliminated. The thermal energy obtained from a catalytic type burning-up oven is used as a heat source for the drying oven and thereby a burner in the drying oven is not necessary. In the case where the printing speed is high and the vaporized amount of solvent is large, the burning of a preheating burner is stopped and thereby the drying operation can be carried out stably under such a condition where the fuel cost is zero for effecting an energy saving.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
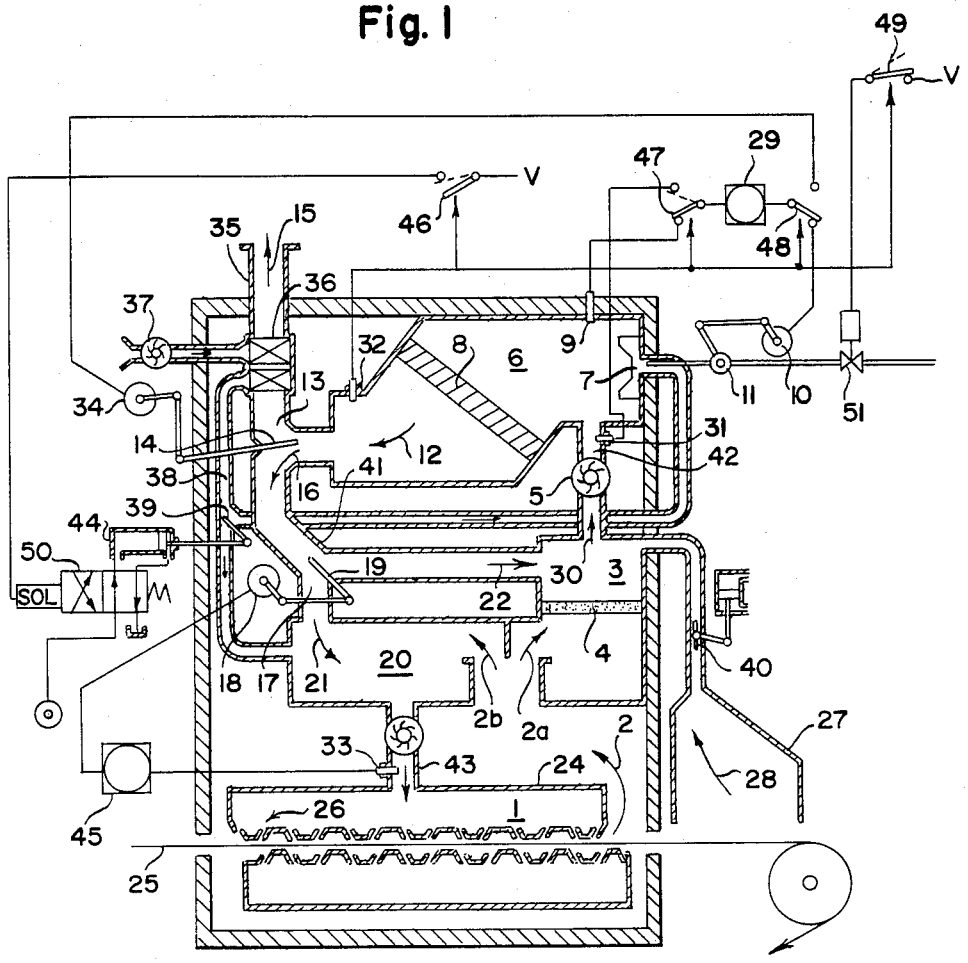
FIG. 1 is a schematic view of one example of the present invention.

One example of the present invention will be now explained with reference to the accompanying drawings. FIG. 1 is a schematic view of one example of the present invention. A circulation system for a process gas is disclosed and will be explained hereinbelow.

A portion 2*a* of the used process gas 2 flowing back from a drying oven 1 enters an odor collecting chamber 3 after passing through a filter 4 and thereafter is supplied to a preheating chamber 6 of a deodorizing system through a fan 5. A preheating burner 7 is provided in the preheating chamber 6. The used process gas 2 including vapors of solvent is preheated to a predetermined extent by the preheating burner 7 so as to be of a high enough temperature to be oxidized by a catalytic layer 8 provided in front of the preheating chamber 6.

Control of the burning of the preheating burner 7 is carried out in such a manner so that a temperature detected by a preheating temperature detector 9 may be maintained at a predetermined value by generating a signal which is supplied to a control motor 10 by a temperature adjusting means 29 and a degree of opening of a fuel adjusting valve 11 for the preheating burner 7 is controlled automatically by the motor 10.

The treated purified process gas 12 having a high temperature resulting from the completion of the treatment wherein the solvent vapors contained in the used process gas are oxidized under an oxidizing catalytic reaction is thereafter divided into two portions. A first diverging portion 13 divided in a duct by a first damper 14 wherein a degree of opening is controlled by a control motor 34 may be discharged into the atmosphere as an exhaust gas 15. The remaining portion of used process gas may be returned from a returning duct 41 as a circulation hot blast of high temperature 16 to the chambers 3, 20.

For instance, the ratios of the amount of the exhaust gas and the amount of the circulation hot blast are controlled as follows:

In the case of a printing operation:
The exhaust portion: 30–50%
The circulation portion: 70–50%

In the case of a temporary stoppage of the printing operation:
The exhaust portion: 15–25%
The circulation portion: 85–75%

The high temperature circulation hot blast 16 is further divided by a control damper 19 provided at a second diverging portion 17 of a duct and operated, in its degree of opening, by a control motor 18, into two portions. A high temperature hot blast portion 21 is directed toward a hot blast mixing chamber 20 and a high temperature hot blast 22 is directed toward the odor collecting chamber 3. The high temperature hot blast 21 and part of a used process gas 2*b* are introduced into the hot blast mixing chamber 20 to form a mixture gas 43 which is blown as a drying process gas 26 against a printed web or sheet 25 through a hot blast blower nozzle 24 by a hot blast circulation blower 23.

On the other hand, the high temperature hot blast 22 directed toward the odor collecting chamber 3 joins, at the odor collecting chamber 3, with a portion 2*a* of the used process gas flowing back from the drying oven 1 and air 28 which is sucked into the chamber 3 from a smoked air collecting hood 27 after the inflow amount of the air is adjusted by a third damper 40. As a result, a collective process gas 30 and the resultant gas is forced to flow into the preheating chamber 6 by the fan 5.

Next, explanation about various kinds of temperature detectors provided for various adjustments in the process gas passages will be discussed hereinbelow.

A temperature detector 31 is provided in a passage 42 through which the collective process gas is supplied into the preheating chamber 6 from the odor collecting chamber 3 by the fan 5 so that a temperature of the collective process gas 30 may be detected. The preheating temperature detector 9 has already been explained hereinabove. A temperature detector 32 is provided in a chamber for detecting a temperature of the treated process gas 12 on the downstream side of the catalytic layer 8 of the deodorizing means. A temperature detector 33 is provided in a passage for detecting a temperature of the drying process gas 43 supplied to the hot blast blowing nozzle 24 by the hot blast circulation blower 23.

A fresh air flow system will be hereinafter described. A heat exchanger 36 is provided in an exhaust duct 35 connected to the first diverging portion 13. Fresh air introduced thereinto by a blower 37 is heated while being passed through the heat exchanger 36, and thereafter is supplied to the preheating burner 7 in the preheating chamber 6 through a combustion air duct 38. The combustion air duct 38 includes a diverging portion with a fourth damper 39 provided at the diverging portion which is opened and closed by an air cylinder 44, and a diverging duct therefrom is connected to the hot air mixing chamber 20.

A temperature adjusting means 45 is connected to the foregoing temperature detector 33, and the control motor 18 is controlled by an output thereof. The degree of opening of the second damper 19 operated by the motor 18 is controlled and thereby the temperature detected by the temperature detector 33 is maintained at a predetermined value.

A temperature adjusting means 29 is connected to the foregoing temperature detector 9, and the control motor 10 is controlled by an output thereof. The degree of opening of the fuel adjusting valve 11 operated by the control motor 10 is controlled and a preheating temperature of the preheating chamber 6 detected by the temperature detector 9 is maintained at a predetermined value.

The foregoing temperature detector 32 is connected to contactors 46, 47, 48, 49. If the temperature of the treated process gas detected by the temperature detector 32 becomes higher than a set temperature, the contactors 46–49 are changed over from the positions shown by solid lines to the positions shown in dotted lines in FIG. 1. Thus, if the contactor 46 is changed over, an electromagnetic type changing over valve 50 is connected to an electric power source V and is energized, so that the fourth damper 39 is operated by the air cylinder 44 operatively connected to the valve 50 so that the supply of combustion air to the preheating burner 7 may be changed to be supplied to the hot blast mixing chamber 20. Thus, the temperature of the collective process gas 30 in the preheating chamber 6 may not be reduced below a predetermined temperature.

If the contactor 47 is changed over as set forth above, the temperature adjusting means 29 is changed over from the temperature detector 9 to the temperature detector 31. If the contactor 48 is switched as set forth above, the temperature adjusting means 29 is changed over from the control motor 10 to the control motor 34. Further, if the contactor 49 is changed over as set forth above, an electromagnetic valve 51 is released from its energized condition connected to the power source V. and the fuel supply to the preheating burner 7 is cut off.

The foregoing temperature adjusting means 29, 45 are known ones, and each thereof includes a measuring instrument which is inputted with a detection signal of the temperature detector connected thereto and which indicates the detected temperature thereof, and a control circuit for generating a control signal of a load apparatus which corresponds to the differential value between the detector temperature and a set temperature.

In general, a hot blast type drying oven of this kind usually uses a hot blast of any suitable temperature ranging from about 180° C. to about 300° C. according to conditions such as the thickness of a printing web of paper, the printing speed, the amount of ink applied thereon, etc. In the conventional hot blast drying oven, any suitable temperature of the drying hot blast can be obtained by adjusting the combustion of the burner.

According to this invention, a burner is not provided which is exclusively used for generating the hot blast. The drying hot blast of any desired temperature can be obtained by mixing the treated process gas 21 having a high temperature and the used process gas 2*b*.

Operations and effects of the present invention will be explained in detail as follows.

By previously setting a hot blast temperature of the process gas 43 for drying by the temperature adjusting means 45, the temperature adjusting means 45 provides the control motor 18 with instructions such that a temperature to be detected by the temperature detector 33 may become the set value. The control motor 18 is controlled so that when a measured temperature detected by the temperature detector 33 is lower than the set value of the hot blast temperature, the degree of opening of the second damper 19 for the hot blast mixing chamber 20 is increased. When the measured temperature by the temperature detector 33 is higher than the set value of the hot blast temperature, the degree of opening of the second damper 19 for the hot blast mixing chamber 20 is decreased, and thus an amount of the treated process gas 21 of high temperature flowing into the hot blast mixing chamber 20 is adjusted.

A blowing amount of the gas by the hot blast circulating blower 23 is constant, so that if the treated process gas 21 of high temperature flowing into the hot blast mixing chamber 20 is increased, an amount of the used process gas 2*b* of a lower temperature flowing back into the hot blast mixing chamber 20 is decreased. Thus, a drying hot blast having a desired temperature can be obtained.

Next, the operation and usefulness of the temperature detector 31 will be explained.

The temperature of the collective process gas 30 detected by the temperature detector 31 corresponds to that of a mixture gas of the treated process gas 22 of high temperature flowing into the odor collection chamber 3, part of the used process gas 2*a* of low temperature 2 and the smoked air 28 of cool temperature sucked from the hood. Therefore, the temperature becomes a value resulting from mixing the treated high temperature process gas 22, the used process gas 2*a* and the section air 28.

Accordingly, in the case where the temperature of the drying process gas 43 is set to be high by the temperature adjusting means 45, and consequently the drying process gas 43 is set to be high, the temperature of the used process gas 2*a* also becomes high. Thus, the degree of opening of the second damper 19 for the hot blast mixing chamber 20 becomes large by the control motor 18 and consequently the supply of the treated process gas 21 to the hot blast mixing chamber 20 is increased. On the other hand, the degree of opening of the second damper 19 for the odor collection chamber 3 is decreased, and the amount of supply of the treated process gas 22 of high temperature becomes small, and the amount of supply of the used process gas 2*a* of low temperature is relatively increased.

On the contrary, in the case where the temperature of the drying process gas 26 is set to be low by the temperature adjusting means 45, the required supply amount of the treated process gas 21 of high temperature to the hot blast mixing chamber 20 becomes less, and accordingly the degree of opening of the second damper 19 for the odor collection chamber 3 increases, and the amount of inflowing of the treated process gas 22 of high temperature into the odor mixing chamber 3 is increased and the amount of inflowing of the used process gas 2*a* of low temperature is decreased. Thus, regardless of the set temperature, the temperature of the collective process gas 30 hardly changes as a result of mixture of both the process gases 22 and 2*a*. However, as a general tendency, if the printing speed is increased and the temperature of the drying process gas 26 is raised as occasion demands, the temperature of the collective process gas 30 also rises with the rise in temperature of the used process gas 2*a*. Accordingly, the combustion amount for heating the collective process gas 30 by the burner 7 in the preheating chamber 6 is somewhat decreased.

In a situation where the amount of the ink applied onto the printed sheet is comparatively large, the amount of solvent vapors to be oxidized by the catalytic layer 8 becomes large, so that the temperature of the treated process gas 12 becomes higher by that amount and accordingly the temperature of the collective process gas 30 is higher, so that the necessary combustion amount necessary for the burner 7 is decreased. In addition, the air for combustion heated by the heat exchanger 36 provided at the exhaust duct 35 becomes also higher in temperature, so that it serves to further decrease the necessary combustion amount of the burner 7.

If the applied amount of the ink is increased and the printing speed is faster and consequently the concentration of the solvent in the collective process gas 30 is increased, the temperature of the treated process gas 12 detected by the temperature detector 32 becomes higher. When this temperature is considerably high, the fuel combustion of the burner 7 is stopped, so that the deodorizing treatment can be carried out under the condition wherein the fuel combustion amount is zero.

Namely, on the occasion when the temperature of the treated process gas becomes high and the temperature thereof detected by the temperature detector 32 exceeds 420° C., the following operation is carried out automatically for preventing the deterioration of the catalyst.

The contactors 46, 47, 48, 49 are operated respectively as mentioned above by an output of the temperature detector 32. The temperature adjusting means 29 which has previously been interposed and connected so far between the temperature detector 9 and the control motor 10 is changed over by the contactors 47 and 48 so that the temperature adjusting means 29 is interposed and connected between the temperature detector 31 and the control motor 34. Thereafter, the control motor 34 is controlled by an output of the temperature adjusting means 29 corresponding to the temperature detector 31 so that the temperature of the collective process gas 30 supplied to the preheating chamber 6 by the odor fan 5 may be maintained at a temperature of 300° C. which is the same as the preheating temperature set by the temperature adjusting means 29, and the first damper 14 at the first diverging portion 13 is controlled by the control motor 34.

By the changing over operation of the contactor 49, the electromagnetic type valve 51 interposed in the fuel passage for the burner 7 is deenergized, so that the combustion of the burner 7 is stopped. Also by the changing over the operation of the contactor 46, the fourth damper 39 is changed over so that the air for combustion which previously has been supplied to the burner 7 may be supplied to the hot blast mixing chamber 20.

If the amount of the solvent vapors in the process gas is decreased and the detected temperature by the temperature detector 32 is lowered, the contactors are returned to their original positions, and thereby the preheating burner 7 is controlled in its combustion operation so that the temperature detected by the temperature detector 9 may be kept at the temperature set by the temperature adjusting means 29.

Figure 2:
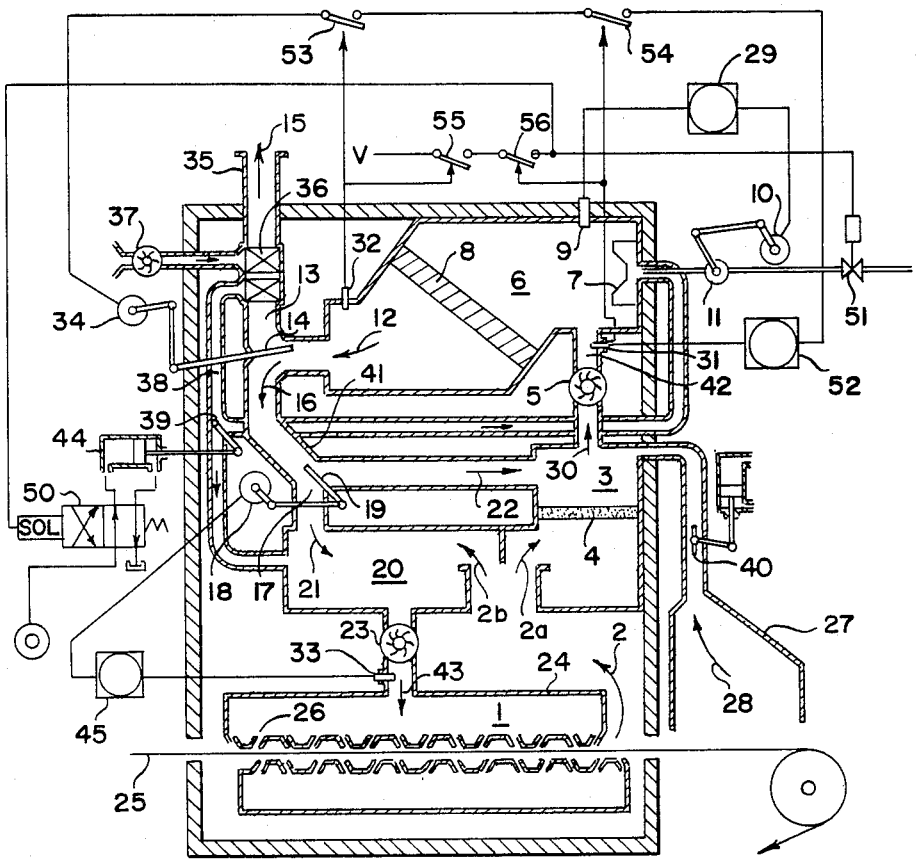
FIG. 2 is a schematic view of another example of the present invention.

FIG. 2 shows a schematical view of another example of the present invention.

In this example, instead of the foregoing example as explained in FIG. 1 in which a changing over operation as discussed above occurs as a result of the predetermined temperature of the treated process gas detected by the temperature detector 32, the second embodiment is arranged so that a similar changing over operation may be caused by a predetermined temperature of the collective process gas 30 detected by the temperature detector 31, for instance, when the temperature reaches 300° C.

In this example, the temperature adjusting means 29 alone is interposed and connected between the temperature detector 9 and the control motor 10. A separate temperature adjusting means 52 is provided interposed and connected between the temperature detector 31 and the control motor 34. In the connecting circuit connecting between the temperature detector 31 and the control motor 34, a contactor 53 is interposed which is energized by an output of the temperature detector 32 and a contactor 54 which is to be energized by an output of the temperature detector 31. In an ordinary operating condition the connecting circuit is opened at the respective contacts of the contactors 53 and 54 so that the control motor 34 cannot be rotated.

The electromagnetic valve 51, which is interposed in the fuel passage, and the electromagnetic changing-over valve 50 connected to the electromagnetic valve 51 are connected to the power source V through a contactor 55 which is energized by an output of the temperature detector 32 and a contactor 56 which is energized by an output of the temperature detector 31. In an ordinary operating condition, the electromagnetic valve 51 and the electromagnetic changing-over valve 50 are deenergized by the respective contactors 55, 56, and consequently the combustion passage is maintained open and the fourth damper 39 which is operable by the air cylinder 44 is positioned as shown in FIG. 2.

The operation of the second embodiment of the present invention with the above circuit will be explained as follows.

If the concentration of the solvent vapors in the collective process gas 30 to be treated by the catalytic layer 8 is increased, the temperature of the resultant treated process gas detected by the temperature detector 32 and the temperature of the collective process gas 30 detected by the temperature detector 31 are both increased. When the temperature of the treated process gas exceeds a certain temperature and the temperature of the collective process gas 30, detected by the temperature detector 31, exceeds an additional set temperature, (for instance 10° C.), which is slightly lower than a set temperature (a preheated temperature) set by the temperature adjusting means 52, the contactors 53, 54 are closed. Thus, a closed connecting circuit is established which comprises the temperature detector 31, the temperature adjusting means 52 and the control motor 34. Thereby, a control can be carried out so that the temperature of the collective process gas 30 may reach the set temperature for the preheating. At the same time, the fuel passage to the burner 7 is shut off, so that the temperature adjusting means 29 indicates only the preheating temperature by an output of the temperature detector 9, but does not control the preheating temperature.

By the changing over of the fourth damper 39, the change in the supply of the air for combustion from the preheating chamber 6 to the hot blast mixing chamber 20 is carried out. Even when the concentration of the solvent vapors becomes low, the temperature of the collective process gas 30 detected by the temperature detector 31 is not lowered, but the temperature of the treated process gas detected by the temperature detector 32 becomes lower than the set value, so that the contactors 53, 55 are returned to their original positions and as a result the connecting circuit of the temperature adjusting means 52 and the control motor 34 is opened and at the same time the fuel passage for the burner 7 is opened and the air for combustion is again supplied to the burner 7. Accordingly, the control of the temperature of the collective process gas 30 ends, and the control of the preheating temperature by the combustion of the burner 7 is again carried out.

According to the examples in FIGS. 1 and 2, as mentioned above, it is possible that when the concentration of the vapors of solvent becomes high, the combustion operation of burner 7 is stopped and thus spontaneous deodorizing treatment of the used process gas without being preheated is carried out.

Figure 3:
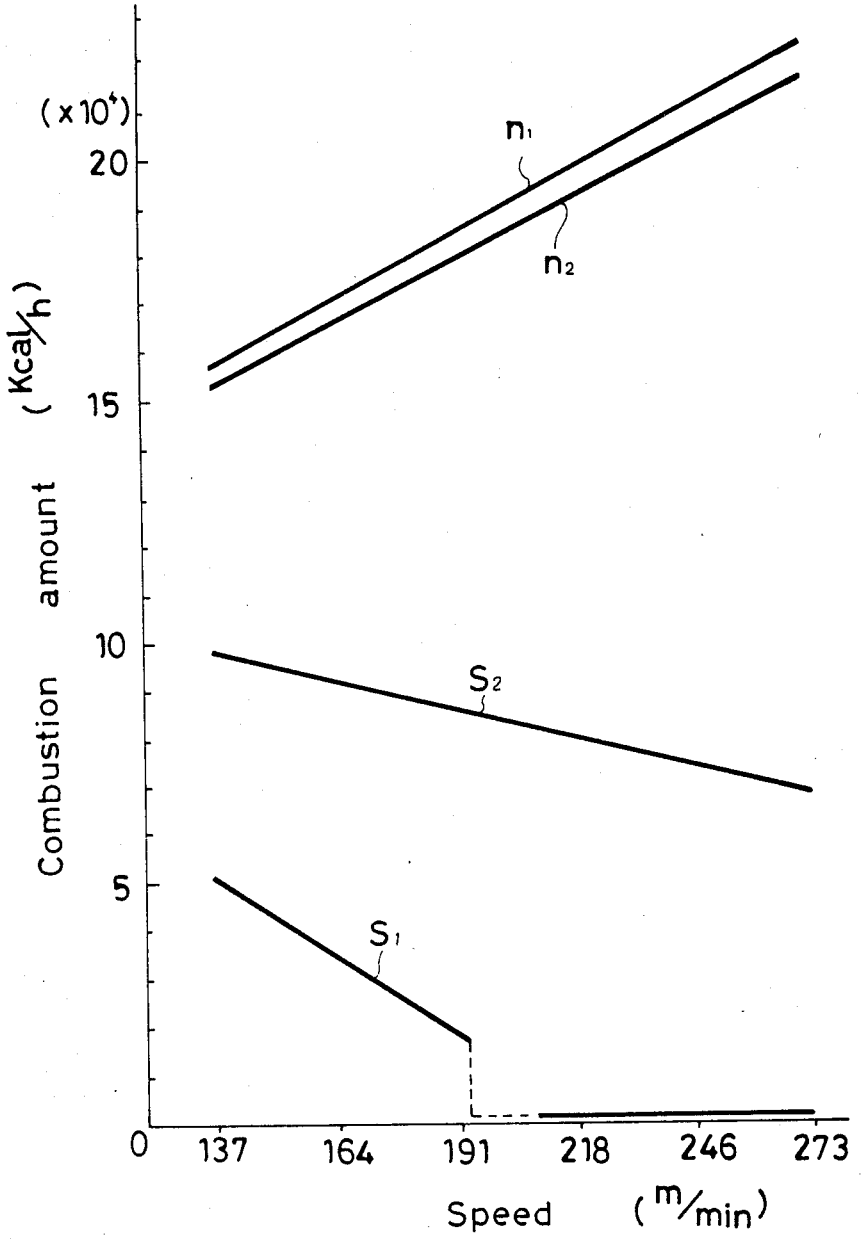
FIG. 3 is a diagram explaining a comparison test on the fuel consumption between the present invention apparatus and a conventional one.

FIG. 3 is a chart showing a comparison between the combustion amount necessary for the preheating burner of the drying apparatus with the deodorizing means according to the present invention and the combustion amount necessary for the burner of the conventional hot blast type drying apparatus which employ the same samples to be tested as described in the following table.

TABLE

| | $n_1$ | $n_2$ | $S_3$ | $S_4$ |
|---|---|---|---|---|
| Area applied with ink | 250% | 150% | 250% | 150% |
| Type of drying apparatus | Hot Blast type of drying oven | | Apparatus according to the present invention | |

In addition, the present invention takes into consideration an energy savings during the preheating operation and during a temporary stoppage of the printing operation. Namely, in order to decrease the amount of calories lost by the discharging of the exhaust gas in the initial state of raising the temperature of the gas to be treated in this apparatus, the first damper 14 is controlled so that the open degree thereof on the exhaust duct side may be made as narrow as half the degree of opening occurring at the time of the printing, while the degree of opening thereof on the circulation duct side may be increased. The second damper 19 in the initial stage of raising the temperature thereof, closes the duct on the hot blast mixing chamber 20, so that the increase in temperature in the preheating chamber 6 is accelerated. When the temperature on the outlet side of the deodorizing means detected by the temperature detector 32 exceeds 220° C., for instance, the second damper 19 is opened and the hot blast circulation blower 23 begins to operate so as to increase the temperature in the drying oven 1. During the period of the above procedure, the third damper 40 is kept in its closed condition for preventing the cool air from being drawn from the hood 27.

The above procedure is carried out by a timer for a predetermined period of time. If the period of time set by the timer expires, the second damper 19 closes the duct on the hot blast mixing chamber 20, and the hot blast circulation blower 23 also stops, but the fan 5 and the burner 7 are maintained in operation so that the catalytic layer 8 may be maintained in such a ready condition so that the catalytic layer 8 is able to deodorize the gas thereafter at any time.

Similarly, also in such a situation wherein the printing operation is temporarily stopped for a short time for carrying out an adjustment of a printing machine or the like, the degree of opening of the first damper 14 on the exhaust side is made very small, the second damper 19 closes on the hot blast mixing chamber 20 side, and the hot blast circulation blower 23 is stopped in order to prevent the deterioration of the web 25 positioned in the drying oven. During the above operation, the odor blower 5 and the burner 7 are continued in operation in order so that the preheating chamber 6 may be kept warm by the minimum thermal amount. During the above procedure, the third damper 40 is closed for preventing the atmospheric air from flowing into the collective chamber 3, so that the greater part of the gas 30 to be sent into the chamber 6 by the odor blower 5 is occupied by the hot blast of high temperature. Therefore, the gas 30 has a high temperature, so that a combusting amount required for the burner 7 can be decreased to a very small amount.

The above operations are carried out automatically by pressing buttons for operating the deodorizing operation and the preheating apparatus, etc., or by using an interlock signal of a speed-down of the printing speed, and so on.

As will be clear from the above explanation, according to the present invention, various advantages are brought about as mentioned below:

(1) The thermal amount generated at the deodorizing means can be used as a thermal source for drying the printed web, so that the drying operation can be carried out by a combustion amount that is much lower than not only the combustion amount necessary for the conventional hot blast type drying oven combined with the deodorizing apparatus, but also the combustion amount necessary for the hot blast type drying oven alone. Thus, an excellent fuel savings can be achieved.

(2) When the vaporized amount of solvent is large as a result of the increase in the ink applied onto the web and/or the speed-up of the printing, or the like, it is possible that the combination amount of the burner may be zero and accordingly the fuel consumption may be zero, as a result of the increase in the amount of vapors of the solvent contained in the ink.

(3) The deodorizing means and the drying oven are combined with each other into a unitary construction, so that the necessary space occupied by the apparatus of the present invention is small and the loss of heat radiated therefrom is decreased.

(4) The gas to be discharged outside is rendered harmless by the catalytic oxidation treatment, and accordingly the apparatus of the present invention can be operated in an urban region.

(5) A fire problem as occurring in the duct of a conventional apparatus can be solved and a safe operation is assured.

(6) Adjustment operations other than the setting operation of a hot blast temperature are not required and, accordingly, the desired drying operation can be carried out easily and automatically.

We claim:

1. A drying apparatus with a deodorizing means for a printing machine comprising:

a hot blast nozzle for directing a hot blast against a printed web for drying the printed material;

deodorizing means including a preheating chamber provided with a burner for preheating a collective process gas including a portion of a used process gas already used during drying operation;

a catalytic layer for oxidizing the used process gas;

a fan for supplying the used process gas through the catalytic layer to an outlet conduit for said preheating chamber, said outlet conduit including damper means for dividing a treated process gas, including a hot blast obtained by the treatment with the deodorizing means into two parts and discharging one part of the two parts and a second damper means operatively connected in a returning duct for subdividing the other part into two parts and introducing one part thereof to an odor collective chamber connected to the preheating chamber and introducing the other part to a hot blast mixing chamber into which the other part of the foregoing used process gas is supplied; and a hot blast circulating blower for supplying a mixture process gas of the treated process gas and the used process gas in the foregoing hot blast mixing chamber to the hot blast nozzle.

2. A drying apparatus with a deodorizing means for a printing machine comprising:

a hot blast nozzle for directing, a hot blast against a printed web for drying the printed material;

deodorizing means including a preheating chamber provided with a burner for preheating a collective process gas including a portion of a used process gas already used during drying operation;

a catalytic layer for oxidizing the used process gas;

a fan for supplying the used process gas through the catalytic layer to an outlet conduit for said preheating chamber, said outlet conduit including first damper means for dividing a treated process gas, including a hot blast obtained by the treatment with the deodorizing means into two parts and discharging one part of the two parts and a second damper means operatively connected in a returning duct for subdividing the other part into two parts and introducing one part thereof to an odor collective chamber connecting to the preheating chamber and introducing the other part to a hot blast mixing chamber into which the other part of the foregoing used process gas is supplied; and a hot blast circulating blower for supplying a mixture process gas of the treated process gas and the used process gas in the foregoing hot blast mixing chamber to the hot blast nozzle, said outlet conduit being provided with a first diverging portion between an exhaust duct for discharging part of the treated process gas and said returning duct connected between the deodorizing means and the hot blast mixing chamber;

said first diverging portion is provided with said first damper means for adjusting diverged amounts of the treated process gas flowing into both the exhaust duct and the returning duct, said first damper means being provided with a control circuit including a first motor and a first switching means for controlling the first damper means to a position for decreasing an amount of the process gas flowing into the exhaust duct when the feeding of the printed sheet is stopped;

said returning duct being provided with a second diverging portion between the deodorizing means and the hot blast mixing chamber;

said second diverging portion is provided with said second damper means for adjusting diverged ratio amounts of the treated process gas flowing into the deodorizing means and the hot blast mixing chamber;

said second damper means is provided with a control circuit including a second motor and a second switching means for controlling the second damper means to adjust an amount of the treated process gas flowing into the hot blast mixing chamber according to increases and decreases of a predetermined set temperature of the mixture process gas contained in the hot blast mixing chamber.

3. A drying apparatus according to claim 2, wherein the second damper means is provided with said control circuit for controlling the second damper means to a position for restraining the treated process gas from flowing into said hot blast mixing chamber when the supplying of the printed sheet is stopped.

4. A drying apparatus according to claim 2, wherein the exhaust duct is provided with a heat exchanger, and the air for combustion for the burner is in communication with and heated by the heat exchanger.

5. A drying apparatus according to claim 2, wherein said control circuit further includes sensing means for controlling a combustion amount of said burner in the preheating chamber according to a signal corresponding to a temperature of the preheating chamber of said deodorizing means for maintaining the preheating temperature equal to a set value.

6. A drying apparatus according to claim 2, wherein said control circuit further includes sensing means for controlling said first motor and a degree of opening of the first damper means at the first diverging portion according to a signal corresponding to a temperature of the collective process gas into the deodorizing means for making the temperature of the collective process gas equal to a set preheating temperature, and for controlling an opening and closing means for a fuel passage to the burner, the control circuit being operated and the opening and closing means for the fuel passage being closed when a temperature of the treated process gas which has passed the catalytic layer becomes considerably higher than the preheating temperature.

7. A drying apparatus according to claim 2, wherein said control circuit further includes sensing means for controlling said first motor and a degree of opening of the first damper means at the first diverging portion according to a signal corresponding to a temperature of the collective process gas into the deodorizing means for making the temperature of the collective process gas equal to a preheating temperature, and for controlling an opening and closing means for a fuel passage to the burner, the control circuit being operated and the opening and closing means for the fuel passage being closed when a temperature of the collective process gas becomes higher than the preheating temperature.

* * * * *